US005408933A

United States Patent [19]

Tanner

[11] Patent Number: 5,408,933

[45] Date of Patent: Apr. 25, 1995

[54] DEVICE FACILITATING RESCUE FROM SKI LIFTS

[76] Inventor: Mark B. Tanner, 3012 Peabody, Bellingham, Wash. 98225

[21] Appl. No.: 182,429

[22] Filed: Jan. 18, 1994

[51] Int. Cl.[6] ..... B61B 12/00

[52] U.S. Cl. ..... 104/112; 104/116; 104/173.1; 104/173.2

[58] Field of Search ..... 104/112, 113, 114, 115, 104/116, 173.1, 173.2, 182; 182/36, 37, 142, 151, 190, 191, 13, 14; 254/387, 389

[56] References Cited

U.S. PATENT DOCUMENTS 3,703,218 11/1972 Brda ..... 182/13
5,081,932 1/1992 Hofmann ..... 104/112

FOREIGN PATENT DOCUMENTS 2415837 10/1974 Germany ..... 104/113
8900121 1/1989 WIPO ..... 104/113

*Primary Examiner*—Mark T. Le
*Attorney, Agent, or Firm*—Robert W. Jenny

[57] ABSTRACT

The basic component of the device is a bent tube. The included angle between the tube portions on each side of the bend is in a range of 90° to 130° with 110° to 120° preferred. The tube portions on opposite sides of the bend are of unequal lengths, 8 inches and 22 inches being an example. A stop is attached to the longer portion approximately two inches from the bend and extending into the included angle. The stop is triangular in plan form. The end of the stop facing the bend is at an excluded angle to the tube surface in a range of 90° to 150° with 135° preferred. The height of the stop is in a range of ¼ to ¾ of an inch. The other sloped face is at an included angle with the tube surface in a range of 10° to 30°. Clamping apparatus is provided which is adjustable to prevent or allow linear relative motion between a line threaded through the tube and the tube. There may be an additional bend in the tube. The centerline of the tube lines in a flat plane. In use the device is installed on and clamped to the line, pulled into place with the bend on a lift cable and then maneuvered by the line to, in essence, make it climb over and past obstacles on the cable.

2 Claims, 1 Drawing Sheet

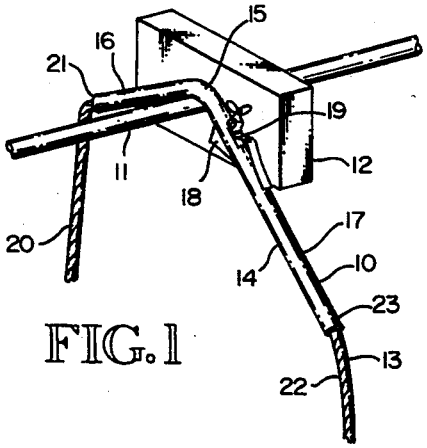
FIG. 1
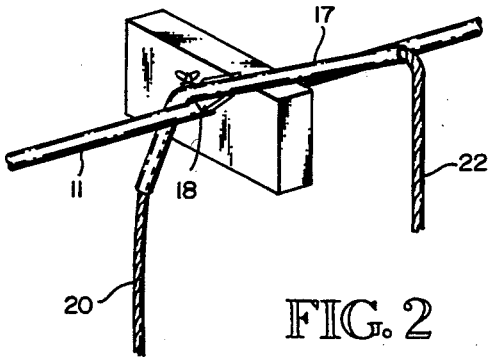
FIG. 2
FIG. 3
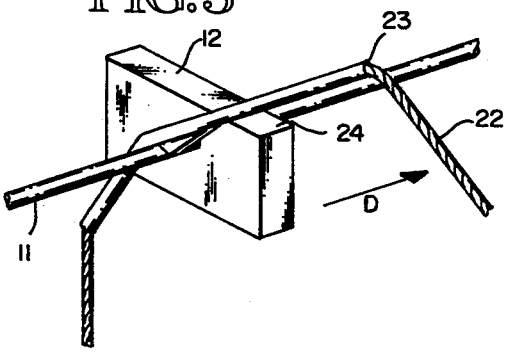
FIG. 4
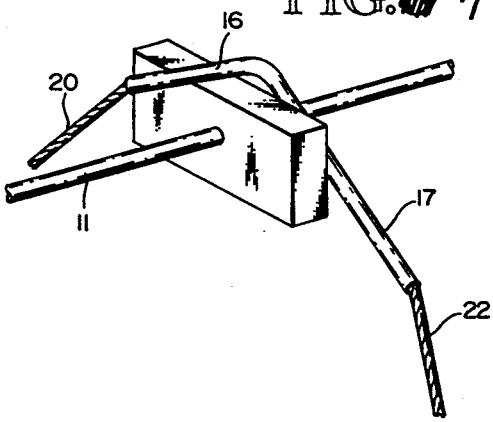
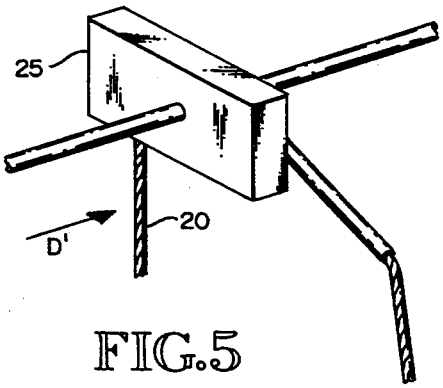
FIG. 5
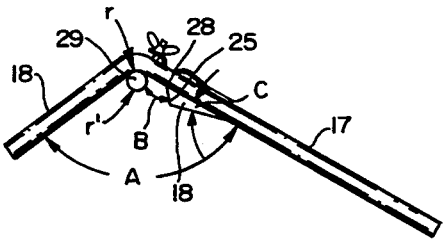
FIG. 6
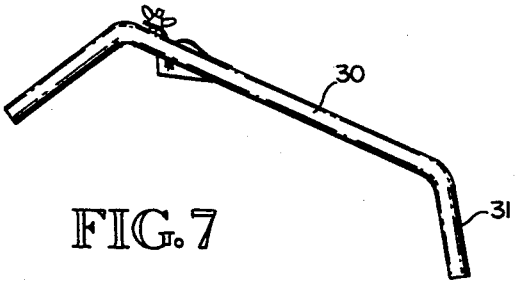
FIG. 7
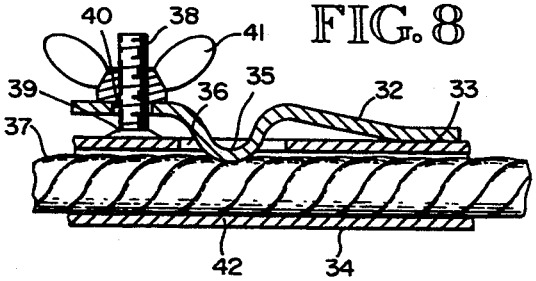
FIG. 8

DEVICE FACILITATING RESCUE FROM SKI LIFTS

BACKGROUND OF THE INVENTION

1. FIELD

The subject invention is in the field of devices and apparatus which enable and facilitate the use of ropes, lines, cables and the like for a wide variety of purposes including rescue operations. It is in the specific field of devices useful in removing people from the user accommodations on stalled ski lifts, such accommodations including seats and cabs and gondolas.

2. PRIOR ART

The seats and other accommodations on stalled ski lifts are often high enough from the ground to make it unsafe for people using the lift to reach the ground without help and there are often situations in which it is urgent for the people to be evacuated from the accommodations as quickly as possible. A well known technique for such evacuation involves positioning a line over the lift cable with both ends of the line accessible from the ground. The line is then moved near an accommodation, and one end of the line is pulled to raise a seat attached to the other end of the line up to the accommodation. A person then transfers from the accommodation to the seat and is lowered to the ground. The line tends to wear from contacts with the cables as it is moved from accommodation to accommodation. It is a well known practice to relieve this wear by running the line through a bent tube which is cradled on the cable during use. The use of the described rescue technique has been significantly complicated by the variety of sizes and design details of the apparatus used for attaching the accommodations to the cables. In many instances it is impossible to move the line past the one attachment apparatus to get to another, so that the line must be removed from the cable and reset for each accommodation. The time required for this is considered unacceptable in many instances. Accordingly, the prime objective of the subject invention is to provide a device which can be used to move the rescue line past the relatively large and complicated apparatuses used to attach ski lift accommodations to ski lift cables. Other objectives are that the device be reliable, easy to use and economical.

SUMMARY OF THE INVENTION

The subject invention is a device for facilitating evacuation of people from stalled ski lifts. The primary part of the device is a tube through which the line used to lower people from the accommodations is passed. The tube is bent, the radius of the bend being essentially equal to the radius of the ski lift cable cross section and, in use, the device is positioned over the cable with the bend portion of the device in contact with the cable. For purposes of this disclosure the portion of the tube between one of its ends and the bend is termed the first arm and the portion of the tube between its other end and the bend is called the second arm.

In all embodiments of the invention the centerlines of the bend and the arms lie in a flat plane and the angle between the arms is in a range of 90° to 130° with the angle in a particular embodiment selected to best facilitate its use. The inside diameter of the tube is no larger than necessary to allow free passage of the line through the tube. The angle and the lengths of the arms are different in various embodiments of the inventions, exact values being selected to adapt the device for best use with each of the variety of types of apparatus used to attach the accommodations to the lift cable. For example, in one embodiment the first arm is 8 inches long and the second arm is 23 inches long and the angle is 106.5 degrees. In a second embodiment the first arm length is 8 inches, the angle is 113 degrees and the second arm length is 32 inches. In a third embodiment the first arm length is 8 inches, the angle is 113 degrees and the second arm length is 35 inches and there is a 45 degree bend 3 inches from the end so that the three inch portion is at an angle of 113°−45°=68 degrees to the first arm.

In most embodiments of the invention there is a clamp installed, usually on the longer of the two arms. The clamp is adjustable so that lengthwise relative motion between the line and the device is free when-the clamp is released and prevented when the clamp is set. In some embodiments the line is permanently restricted from movement through the device. In all embodiments there is a feature termed a stop. The stop extends from the longer of the two arms toward the other arm and its major dimensions are in the plane of the centerlines of the arms. In preferred embodiments the stop is a flat plate, triangular in plan form, with the base of the triangle attached to the arm. Its thickness is in a range of 0.125 to 0.625 inches with 0.375 inches preferred. Its length is in a range of 2 to 4 inches and its height (in the direction away from the arm to which it is attached and in the plane of the centerlines of the arms) is in a range of $\frac{1}{4}$ to $\frac{3}{4}$ of an inch. The end of the stop facing the bend in the tube is at an angle to the surface of the tube in a range of 90° to 150° with 135° preferred (i.e., a 45° slope of the face of the stop). This face extends from one end of the stop to its point of maximum height. The other face slopes from that point to the other end of the stop. The angle between this second face and the surface of the arm to which the stop is attached is in a range of 10° to 30° with 20° preferred. The height, length and angles of the surfaces of the stop with the surface of the arm are obviously interrelated. The face of the stop facing the bend in the device is at a distance in a range of 1 inch to 4 inches from the arm at the opposite end of the head, with 2 inches preferred.

The subject invention is used with a line having appropriate properties threaded through the tube. The line length should be equal to at least twice the height of the lift cable from the ground and preferably three times the height. The extra length simplifies and saves time in the use of the device, as explained below. With the longer line length, the line may be permanently attached in the device, eliminating the need for the adjustable clamp. The device is installed on the line at a point one third of the length of the line from one end of the line and the clamp is adjusted to hold it there. The line is then put in place over the cable, either by fastening a weight to one end of the line and throwing the weight over the cable or by attaching a light line to one end of the larger line and using commercially available equipment to shoot the other end of the light line over the cable and then pulling the line into place. Appropriate tension in the line will bring the device onto the cable with the bend riding on the cable. From this point on there is always tension in both parts of the line extending from the device and the device is maneuvered by adjusting the tensions. The device can be operated by one person but the procedure is speeded up when it is operated by two people. With essentially equal tensions in the two line portions the device is moved along the cable to a position close to the apparatus which is used to attach an accommodation to the cable.

Once the line is in position the device is pulled off the cable and lowered to the ground and the removal of people is done with the two thirds of the line from the device to the remote end of the line. To remove a person from the accommodation a seat is attached to the end of the line and the line is then pulled to raise the seat to the accommodation. A person then moves from the accommodation to the seat and is lowered to the ground. The seat is then pulled back up to the accommodation and the process is repeated until that accommodation is emptied. At this point the accommodation attachment apparatus is an obstacle to movement of the line to the next accommodation without removing the line from the cable. To move the line past the obstacle the subject device is first pulled back into position on the cable next to the obstacle. To move the device (and the line) over the obstacle, the tensions in the line portions are adjusted to raise the long arm of the device. The stop prevents the device from sliding off the cable when the long arm is tilted above horizontal. The line portion from the long arm is then moved to swing the long arm toward and extending over the obstacle. The tensions are then adjusted to lower the long arm over the obstacle on the side of the obstacle to which the device is being moved. Reduction of the tension in the line portion extending from the short arm along with moving that portion in the direction the device is being moved results in the negotiation of the obstacle by the device. It is occasionally useful in performing this operation to whip or twirl a line portion to apply force impulses to move the device as desired. Once the line and device are past the obstacle, the device is pulled along the cable to the next accommodation. The device is then pulled off the cable and the line is used again to remove people.

When the line length is only twice the distance of the cable from the ground the device is locked at the mid length point of the line while the device and line are being moved. The device is then moved to near one end of the line to free up essentially the full length of the line for personnel removal operations and then moved back to the midpoint of the line for moving it and the line along the cable to the next obstruction. The adjustments of the position of tile device on the line require that a weight, such as the T-seat, be attached to one end of the line. The other end is then pulled to remove the device from the cable and bring it down to hand height. It is then unclamped from the device and the line is pulled through it to free up the line for lowering personnel. To reset the device on the cable, the line is pulled through the device until the cable midpoint is again in the device and the line is again clamped in the device. The device is then raised to the cable by the weight at the end of the line. The advantages of using the longer length line are considered to be made clear by this explanation.

The invention is described in more detail below with reference to the attached drawings.

BRIEF DESCRIPTION OF THE DRAWINGS

FIG. 1 is a perspective view of one embodiment of the invention in place on a lift cable near a representative obstacle.

FIG. 2 illustrates the device of FIG. 1 at the first stage of its negotiations of the obstacle.

FIG. 3 illustrates the device of FIG. 1 at the second stage of its negotiation of the obstacle.

FIG. 4 illustrates the device of FIG. 1 at the third stage of its negotiation of the obstacle.

FIG. 5. In this illustration the negotiation of the obstacle is completed.

FIG. 6 illustrates the embodiment of the device of FIG. 1 in plan view.

FIG. 7 illustrates a second embodiment of the invention in plan view.

FIG. 8 is a sectional view of one embodiment of clamping apparatus.

DETAILED DESCRIPTION OF THE INVENTION

The subject invention is a device for moving a line over a lift cable past obstacles on the cable. In FIG. 1, one embodiment of the device 10 is shown resting on lift cable 11 near obstacle 12 with line 13 extending through tube 14 of the device. For purposes of this description the device comprises bend portion 15, arm portion 16, arm portion 17, stop 18 and clamp apparatus 19. The line is prevented from moving through the tube after it has been threaded through the tube by the clamp apparatus, as explained below. Line portion 20 extending from end 21 of the tube and line portion 22 extending from end 23 of the tube both extend to the ground below the cable. Movement of the device and line past the obstacle is illustrated in FIGS. 2–5.

In FIG. 2 the tension in line portion 20 has been made greater than the tension in line portion 22, causing arm 17 to be elevated above horizontal. Stop 18 is preventing the device from sliding off the cable. In FIG. 3, line portion 22 has been pulled in direction D to move end 23 beyond the obstacle 12 and arm 17 over top 24 of the obstacle.

In FIG. 4 the tension in line portion 22 has been made greater than the tension in line portion 20 and the device now is positioned across the obstacle with arm 17 sloping downward and arm 16 essentially horizontal.

In FIG. 5 line portion 20 has been moved in direction D' and, if necessary, line portion 20 has been flipped to clear end 25 of the obstacle and the device and line are past the obstacle.

FIG. 6 illustrates in plan view the embodiment of the device shown in FIG. 1. Arm portion 16 is 8 inches long. Arm portion 17 is 23 inches long. The angle A between the arms is 106 degrees. Radius r of bend portion is essentially equal to radius r' of the cross section of cable 11. Height of stop 18 is approximately equal to the diameter of the cable. Face 25 of the stop is at a 135 degree angle B to arm portion 17. Face 27 is at an angle C of 20° with arm portion 17. Point 28 of the stop is 2 inches from center 29 of the bend portion.

FIG. 7 illustrates a second embodiment of the invention in plan view. This embodiment is similar to that shown in FIG. 6 with the exceptions that arm 30 is 35 inches long overall and the last three inch portion 31 is at a 135 degree angle to the remainder of the arm.

FIG. 8 is a sectional view of a clamping apparatus. Leaf spring 32 is attached at 33 to tube 34. Arch 35 in the spring extends through opening 36 to contact line 37. Screw 38 is attached at 39 to the tube and extends through hole 40 in the spring. Tightening wing nut 41 forces arch 35 against line 37, squeezing the line between the arch and the tube wall 42 and preventing linear relative motion between the line and tube. Loosening the screw allows the line to move freely through the tube.

It is considered to be clear from this description that the subject invention meets its objectives. It provides a device which can be moved over the obstacles on ski lift cables carrying a line with it. The device is easy to use, reliable and, because of its simplicity, economical.

It is also considered to be understood that while certain embodiments of the invention are described herein, other embodiments and modifications of those described are possible within the scope of the invention which is limited only by the attached claims.

I claim:

1. A device for use on a ski lift cable for moving a line passed over said cable past an obstacle on said cable, said line being passed through said device, said cable having a circular cross section having a cable radius, said device comprising:

a tube and a stop, said tube having a bend having a bend radius and an included angle and first and second sides, said bend radius being essentially equal to said cable radius, said tube also having a first tube portion having a first length and extending from said first side and a second tube portion having a second length extending from said second side, said second length being greater than said first length, said included angle being in a range of 90° to 130°, said stop extending from said second tube portion into said included angle and having a face a distance from said first arm in a range of 1" to 4", said face being at an excluded angle to said second tube portion in a range of 90° to 150°.

2. A device for use on a ski lift cable for moving a line passed over said cable past an obstacle on said cable, said line being passed through said device, said cable having a circular cross section having a cable radius, said device comprising:

a tube, a stop and clamping apparatus, said tube having a bend having a bend radius and an included angle and first and second sides, said bend radius being essentially equal to said cable radius, said tube also having a first tube portion having a first length extending from said first side and a second tube portion having a second length extending from said second side, said second length being greater than said first length, said included angle being in a range of 90° to 130°, said stop extending from said second tube portion into said included angle and having a face a distance from said first arm in a range of 1" to 4", said face being at an excluded angle to said second tube portion in a range of 90° to 150°, said clamping apparatus being adjustable such that said line is free to pass through said device and adjustable such that motion of said line through said device is prevented.

* * * * *